US006340070B1

(12) United States Patent
Villareal, Jr. et al.

(10) Patent No.: US 6,340,070 B1
(45) Date of Patent: Jan. 22, 2002

(54) ADJUSTABLE CANTILEVER SCAFFOLDING

(76) Inventors: John W Villareal, Jr.; Mark A Austin, both of P.O. Box 2022, Santa Rosa Beach, FL (US) 32459

( * ) Notice: Subject to any disclaimer, the term of this patent is extended or adjusted under 35 U.S.C. 154(b) by 0 days.

(21) Appl. No.: 09/576,378

(22) Filed: May 22, 2000

(51) Int. Cl.[7] ..... E04G 3/00
(52) U.S. Cl. ..... 182/82; 182/150
(58) Field of Search ..... 182/82, 132, 128, 182/150

(56) References Cited

U.S. PATENT DOCUMENTS 3,679,026 A * 7/1972 Hansen

FOREIGN PATENT DOCUMENTS

| | | | | |
|---|---|---|---|---|
| AT | 232256 | * 7/1963 | ..... | 182/82 |
| AT | 234994 | * 12/1964 | ..... | 182/82 |
| AT | 267817 | * 4/1968 | ..... | 182/82 |
| EP | 179480 | * 4/1986 | ..... | 182/82 |
| FR | 80642 | * 12/1963 | ..... | 182/82 |
| GB | 831148 | * 3/1960 | ..... | 182/82 |

* cited by examiner

*Primary Examiner*—Alvin Chin-Shue
(74) *Attorney, Agent, or Firm*—H. Hampton Hunter

(57) ABSTRACT

An adjustable cantilever scaffold assembly for use in working on the exterior walls of multi-story buildings. The assembly is mounted on an exterior surface of the building such as a walkway or balcony having a safety wall and includes a cantilever beam extending outwardly over the top of the safety wall to provide means for supporting workboards for a workman. When assembled on the exterior surface the scaffold is positioned adjacent to the edge of the surface which permits unencumbered movement of workmen around the scaffold.

5 Claims, 1 Drawing Sheet

ADJUSTABLE CANTILEVER SCAFFOLDING

BACKGROUND OF THE INVENTION

1. Field of the Invention

This invention relates generally to scaffolding employed to work on the exterior walls of multi-story buildings. More particularly, the invention involves an adjustable cantilever scaffolding to be employed on the upper face of a surface such as a walkway or balcony of a multi-story building and includes a cantilever portion extending over the safety wall of the surface to provide a support for workboards for a workman.

2. Description of the Prior Art

Maintenance and repairs to the outside walls of multi-story buildings have always proven to be difficult and expensive, especially those buildings that include outside supporting surfaces, such as walkways or balconies, which increases the areas that are difficult to reach. Various techniques have been employed to reach the areas needing work; the more common ones involve the use of stacked scaffolding for the lower floors and suspended scaffolding from the rooftop. Stacked scaffolding becomes impractical as the number of floors increases and safety of workmen becomes a greater problem. On the other hand, suspended scaffolding is difficult, time consuming and expensive to install. Hansen et. at. (U.S. Pat. No. 3,679,026) is the closest prior art known to applicants. It is directed to a scaffolding arrangement employed in constructing a major portion of the outer walls of a building. The scaffolding is set up on the inside of a partially constructed building with an arm of the scaffold extending outwardly of a partially completed outer wall providing support for workboards for the bricklayer to stand on to complete a major portion of the outer wall. Portions of the wall in the shape of a window or similar opening are left unfinished in the wall in order to retract the support arm as the scaffolding is removed. The unfinished openings in the wall are later closed by using scaffolding suspended from the roof.

Accordingly, it is an object of the present invention to provide a novel scaffold assembly that is mounted on an exterior horizontal surface of a building, such as a walkway or balcony, that includes cantilever means extending outwardly thereof to provide support for a worker.

A more specific object of this invention is the provision of a novel, fully adjustable scaffold assembly that is mounted on the upper face of a walkway or balcony of a multi-story building. The scaffold assembly utilizes a cantilever support beam extending over the balcony safety wall to support a worker.

A further object of this invention is to provide a novel scaffold assembly mounted on the surface of a walkway or balcony having a safety wall, the scaffold assembly includes a cantilever support beam extending over the safety wall for supporting a first worker and a second support suspended from the support beam and extending to a level below the worker to carry a second worker.

Another important object of the present invention is to provide a novel scaffold assembly that is mounted on an exterior horizontal surface of a multi-story building such as a walkway or balcony that includes a safety wall. The scaffold assembly includes a cantilever support beam that extends over the safety wall, and when positioned on the horizontal support surface, most components of the assembly are near the periphery of the support surface. This construction provides ample obstruction-free space on the support surface which permits unencumbered movement of workmen around the scaffold.

SUMMARY OF THE INVENTION

The present invention alleviates many of the problems encountered in using conventional scaffolding. Specifically, this invention provides a novel adjustable cantilever scaffold apparatus to easily access the more difficult to reach areas around the balconies of multistory buildings. The entire scaffold structure is mounted on the floor of a balcony or similar structure and includes cantilevered beams extending outwardly over the wall of the balcony to support workboards for the workers. Most components of the assembly are positioned near the periphery of the support surface when assembled to permit unencumbered movement of workmen around the scaffold.

These and other important objects and advantages of the invention will become apparent as this description proceeds.

DESCRIPTION OF THE PREFERRED EMBODIMENT

Figure 1:
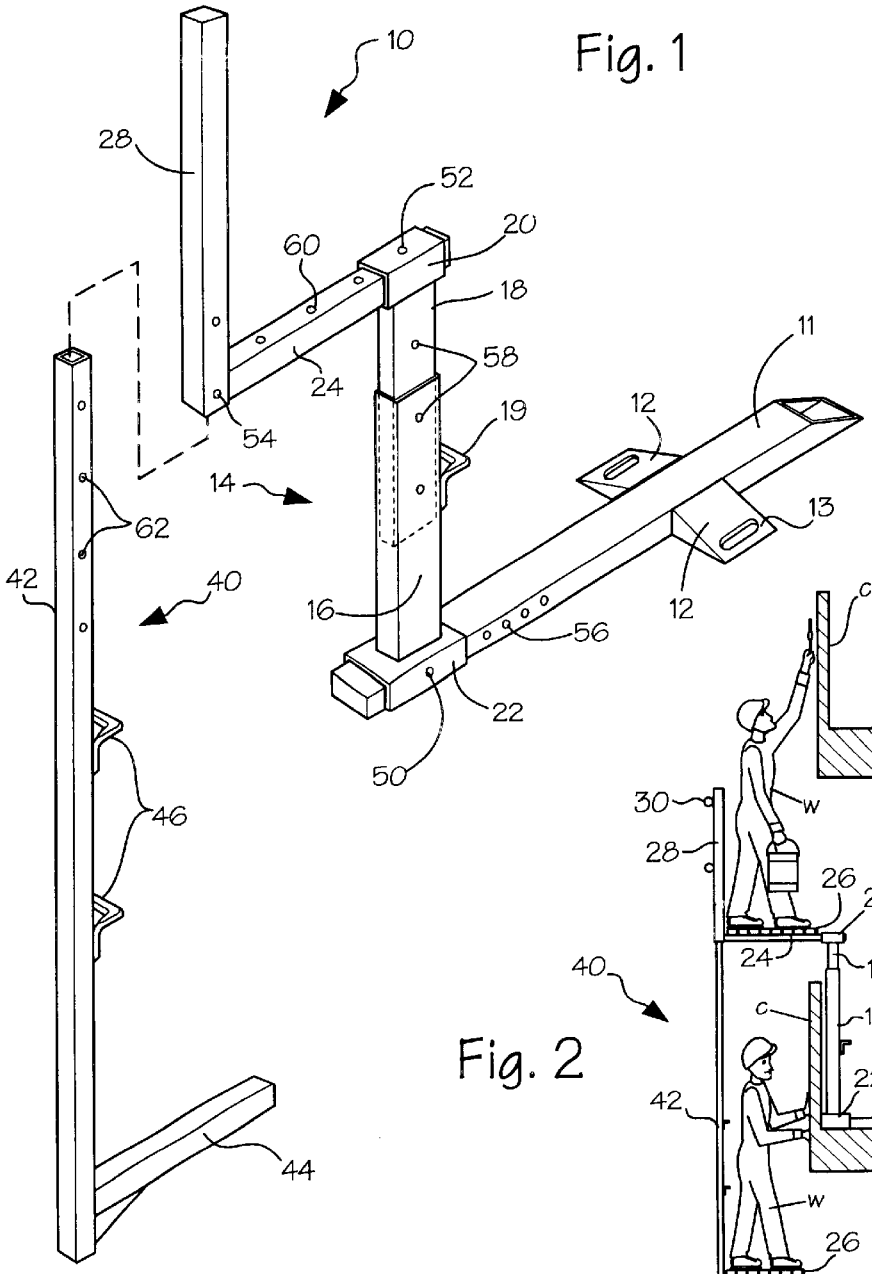
FIG. 1 is a perspective view of the scaffold assembly constructed in accordance with the invention; The optional support for a second workman is illustrated in a separated condition for sake of clarity.

Referring now to the drawings and particularly FIG. 1, a scaffold assembly in accordance with the invention is generally designated by the reference numeral 10. The assembly 10 is mounted on a balcony b having a safety wall c on an outer wall of a multi-story building b, see FIG. 2. (It should be noted that for purpose of simplicity the scaffold assembly 10, of rule invention is described herein as mounted on a balcony of a multi-story building b. It is obvious that the assembly can be mounted on any type of horizontal walk surface on the exterior of the building.) The scaffold assembly 10 includes a support foot 11 positioned transverse to the length of the floor of the balcony b. Support foot 11 is provided along its length near the mid-point with laterally extending stabilizing arms 12 to eliminate any tendency of tilting by the scaffold. The stabilizing arms 12, which include sloping upper surfaces to permit passage of wheelbarrows, can be of any desired length and are provided with slots 13 adjacent the ends to serve as handles to assist in portability. The length of the foot 11 can vary as discussed in greater detail below, but should be at least of sufficient length to permit the passage of workmen and wheelbarrows thereover. The outer end of the foot 11 is positioned adjacent the base of safety wall c and is adjustably positioned within a lower adjusting sleeve 22 secured to the lower end of telescoping standard indicated generally at 14. Telescoping standard 14 includes an outer post 16 rigidly secured to lower adjusting sleeve 22, an inner post 18 adjustably positioned inside said outer post 16 and having upper adjusting sleeve 20 rigidly secured thereto. A carrying handle 19 is secured to outer post 16. The length of telescoping standard 14 is adjusted to insure that upper adjusting sleeve 20 is located at a preferred level above the upper edge of safety wall c. Slidably received within upper adjusting sleeve 20 is the inner end of cantilever support beam 24, the outer end of the support beam 24 extends horizontally outward beyond the top of safety wall c for a distance sufficient to carry workboards 26 to support a workman. Secured to the outer end of support beam 24 is an upright safety standard 28 which confines the walkboards 26 on support beam 24 and carries safety means 30 (FIG. 2) such as rope, chain or boards for protection of the workmen.

While not illustrated for sake of simplicity, it should be noted that bracing extending at angle between inner post 18 and cantilever support beam 24 can be employed to ensure safety of the workmen. When bracing is employed, the inner post 18 must extend above the top of safety wall c a sufficient distance (see FIG. 2.) to provide space for the same.

Figure 2:
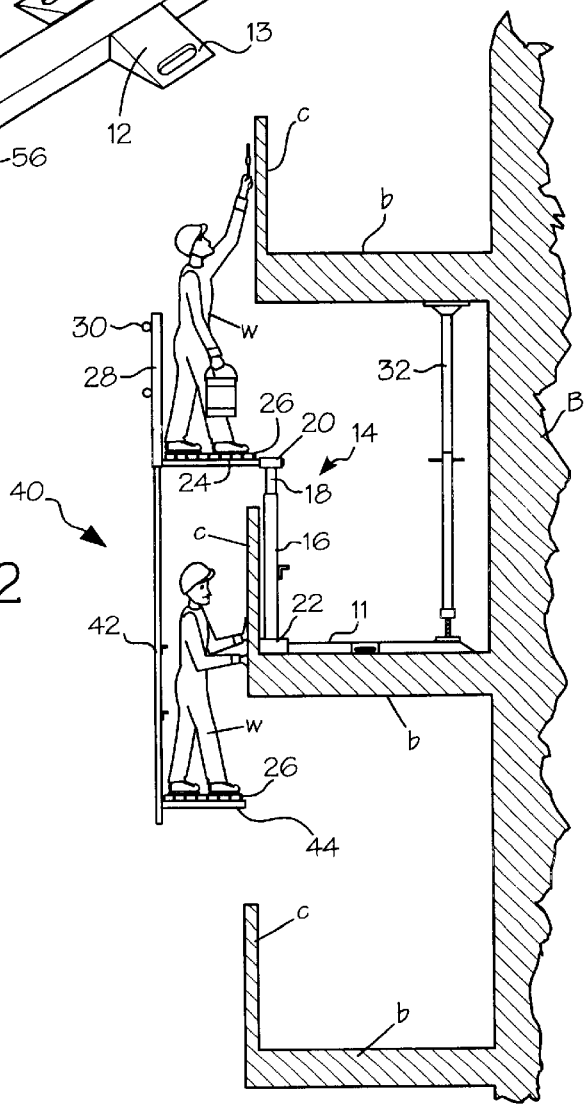
FIG. 2 is a somewhat schematic illustration of the scaffold assembly in use on the side of a multi-story building.

The scaffold assembly 10 of this invention can optionally carry additional scaffold mechanism designated generally at 40 providing for workmen on a lower or second level below the first working level. FIG. 2 schematically illustrates this arrangement under working conditions. Mechanism 40, best illustrated in FIG. 1, includes tubular support standard 42 that is adjustably secured inside safety standard 28, a horizontally extending support beam 44 rigidly secured to standard 42 to support a second level of workboards 26 thereon and safety restraint brackets 46 which also function as carrying handles. When properly positioned, mechanism 40 will position the workman on a lower level to work on the next lower balcony.

The adjustability of the scaffold assembly 10 of this invention is important in that it provides the ability to fit the scaffold to the work area. Any kind of adjustment means can be employed, however, we prefer to utilize the well known combination of slidable fittings employing alignable adjustment holes with locking pins inserted therein to secure the pieces in adjusted position. The adjustable connections for the foot 11 and lower sleeve 22 are shown at 50 and 56, the adjustment holes for the outer post 16 and the inner post 18 of the telescoping standard 14 are shown at 58, the adjustable connection between the upper sleeve 20 and the support beam 24 are shown at 52 and 60, and the adjustable connection between the safety standard 28 and the support standard 42 of the scaffold mechanism 40 are shown at 54 and 62. The conventional locking pins employed in these connections can be of any well known construction and for sake of simplicity has not been illustrated.

In use, the manner in which the adjustable scaffold assembly 10 of the present invention is secured on the surface of the balcony b is also an important part of this invention. As pointed out above, the support foot 11 should be of a length of sufficient to provide for the passage of a wheelbarrow thereover between the upright telescoping standard 14 and the means anchoring the support foot 11 to the balcony b. The anchoring means comprises a conventional jack screw 32 (FIG. 2) that is fixed between the support foot 11 at its lower end and the underside of the balcony above at its upper end as is well known in the building construction art. The location at which the jack screw 32 is placed along the length of the support foot 11 is important. Theoretically, the jack screw 32 can be positioned at any point along the length of support foot 11 from a position closely adjacent telescoping standard 14 to a position at the rear end of support foot 11 adjacent the wall of building b and such range of placement is deemed to be within the scope of this invention. However, placement of the jack screw 32 along the length of the support foot 11 a distance substantially equal to the adjusted length of the support beam 24 is preferable in order to utilize the mechanical advantage of such placement to counteract the resulting downward forces on support beam 24 when in use by a workman. Such placement also provides the desired spacing to permit workmen and wheelbarrows to pass between standard 14 and jack screw 32. Movement of jack screw 32 further away from telescoping standard 14 along the length of support foot 11 and closer to the exterior wall of building b simply enhances the mechanical advantage of the system and opens up the unencumbered space for movement of workmen and materials. It is noted that in use the scaffold assembly employs two laterally spaced and aligned identical assemblies 10 that cooperate to provide means for supporting the walkboards 26 suspended therebetween. This arrangement of scaffolding is well known in the art as shown in the patent to Hansen et. al. discussed above. See FIGS. 1 and 4 and the related description thereof. Accordingly, this conventional arrangement has not been specifically illustrated although FIG. 2 herein is an end view of the scaffold assembly of this invention wherein two such assemblies 10 are employed to provide the necessary support for walkboards 26.

The materials employed in constructing the adjustable cantilever scaffold assembly 10 of the present invention comprise heavy steel rectangular tubing that prevents relative rotation of components at the adjustable connection and that are capable of carrying the loading presented by this invention. Obviously, any materials and/or configuration of material. That is capable of carrying out this invention is deemed to be within the scope of this invention.

While the scaffold assembly of the present invention has been disclosed for employment on previously constructed buildings wherein the safety walls on walkways, balconies, etc have been installed it is also intended that the scaffold assembly hereinalso be employed on buildings that are under construction. In some instances it could be necessary to employ the scaffold assembly on walkway or balcony surfaces that have not been provided with the usual safety walls. Although, safety walls are preferable, it is obvious that the present invention can meet it's objectives with or without such safety walls being installed.

While a preferred embodiment of the present invention is shown in the drawings and described above, it is to be understood that those skilled in the art will readily appreciate that certain modifications, changes and substitutions may be effected with regard to the disclosed structure, insofar as these modifications, substitutions and alterations fall within the spirit and scope of the present invention as defined by the claims appended hereto, they are contemplated.

What is claimed is:

1. An adjustable scaffold for performing maintenance and repairs on the outside of an existing multi-story building, said scaffold being mounted on an exterior supporting surface such as a balcony, said surface including an upstanding safety wall adjacent a free edge thereof opposite an exterior building wall, said scaffold including cooperating laterally spaced scaffold assembly members for supporting workboards therebetween thereby providing a platform for supporting a workman, each scaffold assembly member comprising:

an elongated support foot extending across and positioned on said surface and including an inner end adjacent said building wall and an outer end adjacent said safety wall, means adjacent said building wall securing the inner end of said support foot to said supporting surface by applying a downward force on an upper surface of said support foot, an upright standard secured to said support foot adjacent said safety wall, means for adjusting the height of said upright standard to extend its upper end to project above said safety wall, a supporting beam secured to said upright standard, said supporting beam extending substantially horizontally outwardly over the top of said safety wall a distance sufficient to provide for the placement of said workboards thereon, an upright safety standard secured to the end of said supporting beam, and said support foot being unobstructed between the location of the upright standard adjacent the outer end and the location of the securing means adjacent the inner end whereby said scaffold assembly members provide ample space on said supporting surface for unencumbered movement of workmen closely adjacent said scaffold.

2. The scaffold set forth in claim 1, wherein said securing means is a jack screw positioned to apply pressure to the upper surface of said support foot.

3. the scaffold set forth in claim 1, including means for adjusting the length of said support beam.

4. The scaffold set forth in claim 1, wherein said support foot extends from said telescoping standard toward said exterior wall a distance substantially equal to the length of said support team.

5. An adjustable scaffold for performing maintenance and repairs on the outside of an existing multi-story building, said scaffold being mounted on an exterior support surface such as a balcony projecting outwardly from an exterior wall, said support surface including an upstanding safety wall adjacent a free edge thereof opposite said exterior wall, said scaffold including cooperating laterally spaced scaffold assembly members for supporting workboards therebetween, each scaffold assembly member comprising:

a support foot positioned on said support surface, an upright standard adjustably secured to said support foot adjacent said safety wall, means for adjusting the length of said upright standard whereby said upright standard projects above said safety wall, a supporting beam adjustably secured to said upright standard adjacent the upper end of said upright standard and extending horizontally outwardly over the top of said safety wall a distance sufficient to provide for the placement of workboards thereon, said support foot being elongated including an outer end adjacent said safety wall and carrying said upright standard adjacent said outer end, said support foot extending rearwardly toward said exterior wall a distance substantially equal to the adjusted length of said supporting beam and jack screw means adjacent the inner end of said support foot applying a downward force thereon for securing said support foot to said support surface, the support foot being unobstructed between the location of the upright standard adjacent the outer end and the location of the jack screw securing means adjacent the inner end whereby said scaffold assembly members leave ample space on said support surface for unencumbered movement of workmen closely adjacent said scaffold.

* * * * *